United States Patent [19]

Nethery

[11] Patent Number: 4,729,198

[45] Date of Patent: Mar. 8, 1988

[54] GRAIN SILO SEALING

[75] Inventor: Timothy J. Nethery, Cronulla, Australia

[73] Assignee: Nethchem Pty. Ltd., New South Wales, Australia

[21] Appl. No.: 22,079

[22] Filed: Mar. 3, 1987

[30] Foreign Application Priority Data

Mar. 7, 1986 [AU] Australia ..... 54429/86

[51] Int. Cl.[4] ..... E04H 7/22; E04F 19/04

[52] U.S. Cl. ..... 52/169.14; 52/192; 52/63; 52/245; 52/393

[58] Field of Search ..... 52/3, 63, 169.1, 169.12, 52/169.14, 192, 245, 247, 393–396

[56] References Cited

U.S. PATENT DOCUMENTS

| | | | |
|---|---|---|---|
| 3,092,933 | 6/1963 | Closner et al. | 52/169.14 X |
| 3,685,232 | 8/1972 | Steffen | 52/245 X |
| 4,084,358 | 4/1978 | Winters | 52/63 X |
| 4,287,691 | 9/1981 | Guenther | 52/192 X |
| 4,660,337 | 4/1987 | Ross et al. | 52/3 X |

*Primary Examiner*—J. Karl Bell

*Attorney, Agent, or Firm*—Dellett, Smith-Hill & Bedell

[57] ABSTRACT

An expansion joint for a grain silo is sealed by a mesh-reinforced diaphragm having its peripheral edge-portions bonded to surfaces of the silo adjoining the joint to form a continous seal around it. The intermediate portion of the diaphragm has a flexible bulging portion protecting the joint and spaced from it. The diaphragm is made by covering the joint with a separating strip and applying a thick continuous layer of a viscous sealing agent over the exposed faces of the strip and the adjoining silo surfaces. The mesh is incorporated into the layer and has stiffly-resilient strands extending in the direction of flexing of the diaphragm. The layer cures to form the diaphragm which separates spontaneously from the separation strip the first time the silo expands, to form a bulging portion in the diphragm around the joint.

11 Claims, 2 Drawing Figures

GRAIN SILO SEALING

FIELD OF THE INVENTION

This invention relates to a grain storage silo and is more specifically concerned with improving a farm silo designed to provide a cheap and safe temporary storage for harvested grain.

STATE OF THE ART

Harvested grain often has to be held on a farm in silos until it can be inspected and bought by a grain handling authority. It is then transported to large commercial silos where the grain can be kept under controlled atmospheric conditions for an almost indefinite period.

Various factors can result in the grain having to be stored in the commercial silos for a protracted period. For example, a glut in the supply of grain to the world market or industrical action will cause this. If the commercial silos are full for a protracted period during which a good grain harvest occurs, the authorities will not accept new grain as there is no silo space available to hold it. The farmer must then hold his grain in his own farm silo for an extended period for which it was not designed. This can result in a deterioration in the quality of the grain so that it is not worth as much, or in it being condemned because of an insect or other infestation which occurred as a result of the excessively long storage time in the farm silo which is not designed for this purpose.

A usual construction of a farm grain silo comprises a concrete plinth on which the silo stands. The silo is commonly a corrugated upright cylinder bolted at intervals to the plinth and roofed over. Such a silo gives protection from the weather. However it does not provide an air-tight enclosure and the environment within the silo is not temperature-controlled. Fumigation of the grain during storage has to be periodically carried out to prevent infestation by insects discharged into the silo with incoming grain, or entering it through expansion joints which are necessary to allow the silo to expand and contract with change in the weight and pressure of grain it contains and, to a lesser extent, with change in ambient temperature. The expansion joints prevent hermetic sealing of the silo and the retention of fumigation gas in a silo for a sufficient time to be fully effective, cannot be guaranteed.

The effective sealing of the base region of a farm grain silo poses a particularly awkard problem to solve and this is the zone in which infestation by insects is most likely to occur. U.S. Pat. Nos. 3,402,519 and 4,287,691 both teach ways a silo may be constructed to prevent or reduce this souce of infestation. In neither case, however, is the solution proposed capable of being applied to a traditionally constructed grain silo.

OBJECT OF THE INVENTION

An object of the invention is to provide a relatively cheap and effective way of sealing the expansion joints of a grain silo.

SUMMARIES OF THE INVENTION

In accordance with one aspect of the invention a grain silo has an expansion joint sealed by a bulging portion of a flexible diaphragm spaced from the joint and whose marginal edge-portions adhere to adjoining surfaces of the silo around the joint to provide continuous air-tight seals, a separating medium being located between the joint and the bulging portion of the diaphragm.

In accordance with a second aspect of the invention a method of sealing an expansion joint of a grain comprises the steps of placing a separating medium over one side of the joint, applying over the medium and adjacent portions of the silo a continuous thick layer of a viscous compound which cures on drying to form a flexible diaphragm covering the joint and bonded tightly to the silo surfaces surrounding the joint but only weakly to the separating medium so that subsequent working of the joint causes the intermediate portion of the diaphragm to separate from the medium and form a bulge spaced from the two surfaces of the joint which move with respect to one another during working of the joint.

PREFERRED FEATURES OF THE INVENTION

Preferably the diaphragm is formed by coating the joint with two layers of the compound superimposed on one another, and between which is embedded flexible reinforcement. The flexible reinforcement provides stiffly resilient strands extending medially through the diaphragm and into its opposite edge-portions which are bonded to the silo surfaces. The diaphragm is then reinforced in the direction in which it is required to flex during working of the joint, either through expansion or contraction of the silo.

The stiffy resilient strands of the reinforcement are conveniently provided by parallel nylon monofilaments which are bound together in a mesh by soft fibrous filaments. These preferably also alternate with the monofilaments. The reinforcement is arranged in the diaphragm so that the stiffly resilient monofilaments extend in the direction of flexing of the bulging portion. They thus prevent it from creasing in the direction of working of the joint should a heavy load be rested on the diaphragm, because the monofilaments exhibit a high resistance to being bent through a sharp angle.

The invention is particularly well-suited to sealing the expansion joint occurring between the lower end of a corrugated iron wall of the silo and a supporting concrete plinth, so that the joint is sealed against the ingress of moisture and insects. The diaphragm can be applied to an existing corrugated iron farm silo to improve it, and may also be applied to the outside of a silo when filled with grain without having to remove the grain it may be storing.

The invention is also usable to seal other expansion joints of the silo. It is possible, by using the invention, to totally seal a conventionally constructed silo so that it can be fumigated more effectively and then be provided internally with a controlled atmosphere so that it can store grain for a prolonged period. Also, by extending the coating compound from which the diaphragm is formed, over the entire external surface of the silo and having it coloured white, the temperature inside the silo can be more easily controlled as it is less affected by external radiant heating.

INTRODUCTION TO THE DRAWINGS

The invention will not be described in more detail, by way of example, with reference to the accompanying diagrammatic drawings, in which:

IN THE DRAWINGS

FIG. 1 shows a grain silo with a sealed expansion joint around the lower end of a wall of the silo; and, FIG. 2 is a vertical section, on an enlarged scale, through the sealed expansion joint of FIG. 1.

DESCRIPTION OF PREFERRED EMBODIMENT

Figure 1:
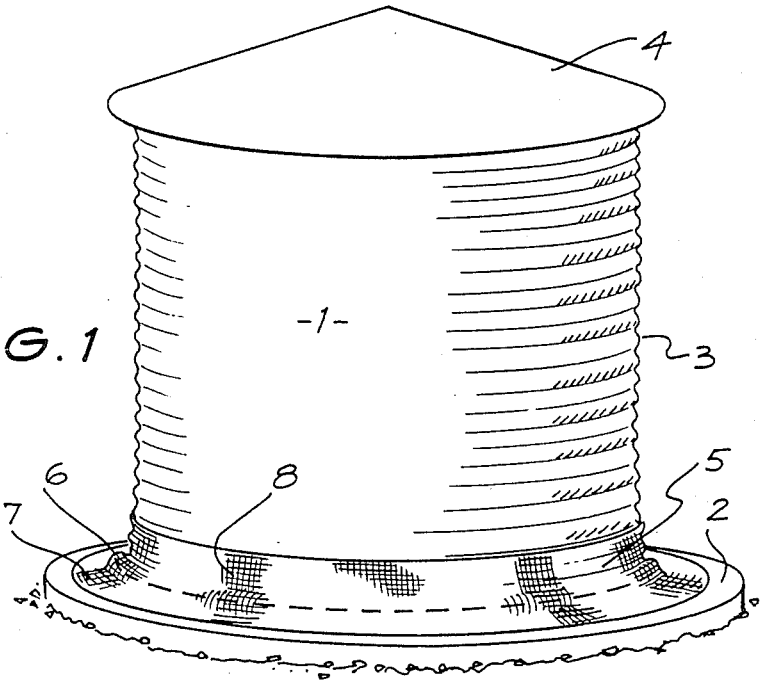

FIG. 1 shows a grain silo 1 comprising a concrete plinth 2 on which stands a corrugated iron wall 3 of the silo. The silo is covered by a roof 4. A grain entry and outlet are of conventional design and are not shown in the view of the silo seen in FIG. 1.

The lower portion of the silo wall 3 is covered by a continuous flexible diaphragm 5 bonded at one marginal edge portion 8 to the silo wall 3, and at the opposite marginal edge-portion 7 to the upper surface of the plinth 2. A bulge 6 of the diaphragm extends around the foot of the wall 3 to provide a seal which accommodates expansion and contraction of the wall 3 with respect to the plinth 2 as the quantity of grain held in the silo increases and decreases, respectively.

Figure 2:
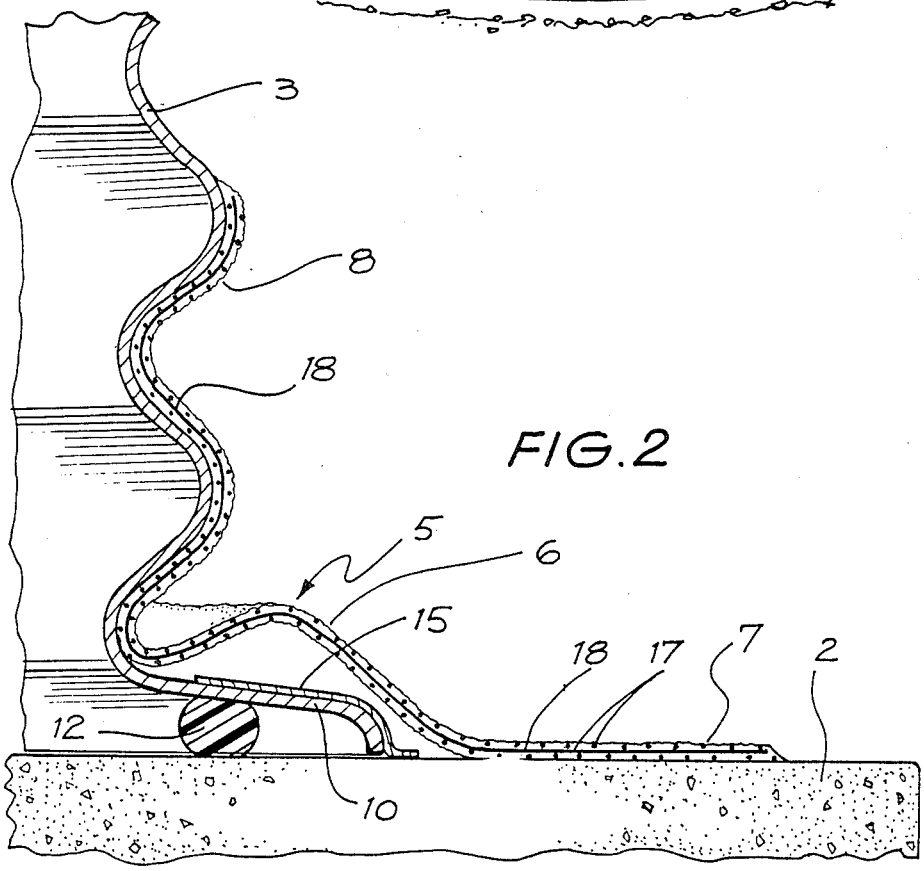

FIG. 2 shows the lower portion of the wall 3 has having an outwardly extending foot 10 which rests on the plinth 2 and slides along it to accommodate radial expansion of the wall 3. Beneath the foot is trapped a resiliently flexible rod 12 which provides an infestation barrier beneath the foot and rolls on the plinth 2 during movement of the foot 10.

The diaphragm 5 is made as follows:

First a separating medium provided by a strip of conventional paper masking tape 15, is stuck over the upper surface of the foot 10 and the portion of the plinth 2 immediately surrounding the foot 10, as shown. A thick continuous layer of a viscous sealing compound is then applied as a coating to the outer surfaces of the lower part of the wall 3, the upper surfaces of the foot 10 and the surrounding portion of the plinth 2. This layer naturally also covers the separation strip 15.

While the layer is still wet, a reinforcement mesh or net 17 is placed on it so that parallel reinforcing strands 18 of the net extend down the portion 8, over the foot 10 and along the portion 7. A second continuous thick coating of the compound is then applied as a layer over the top of the net 17 so that the compound fills the interstices in the net and bonds itself to the compound layer already applied. The layers of the compound are applied while the silo is in its unexpanded condition.

The compound layers are allowed to dry and form a flexible, reinforced, rubbery diaphragm about 3 millimeters thick. The bonding of the edge portions 8 and 7 of the diaphragm to the outer surfaces of the wall 3 and plinth 2 forms continuous air-tight and insect-proof seals. The intermediate portion of the diaphragm is only weakly keyed to the separation strip 15 so that it breaks free from it the first time the silo expands, to form a 'lazy' fold of the bulge 6.

OPERATION OF PREFERRED EMBODIMENT

The foot 10 moves over the surface of the plinth 2 to provide an expansion joint which accommodates increase in radius of the silo. As the foot moves outwards, it is not impeded by the diaphragm as the bulge 6 is spaced from the surfaces of the plinth and foot which move relative to one another. The flexible nature of the diaphragm allows it to be walked on and subjected to normal wear without damage and without imparing the efficiency of the seal it provides.

In one example of a seal made as described above, the various constituents are as follows:

The viscous compound used to form the diaphragm is commercially available in Australia under the trade mark "FLEXI-CLAD".

The reinforcing net embedded in the diaphragm is a composite structure of nylon monofilament reinforcing strands held in a parallel relationship by spaced fibrous polyesther filaments which also alternate with the nylon strands. The mesh or net is commercially available in Australia from Downs Coulter (1950) Pty. Limited, of Melbourne, under the trade mark 'NYLO-MATT'.

The separating medium comprises an adhesive-backed crepe paper strip having a ripple finish and commerically available in Australia under the trade mark 'VENHART'.

Although the invention has specifically been described with reference to sealing the lower portion of a silo wall to a supporting concrete plinth, it is usable anywhere in the silo construction where an expansion joint is necessary and sealing is required. Also, the diaphragm can be applied inside the silo and the separating strip fixed to surfaces from which the diaphragm can separate to form the bulge or lazy fold, during subsequent working of the joint.

What is claimed is:

1. A grain silo having an expansion joint sealed by a bulging portion of a flexible diaphragm spaced from the joint and whose marginal edge-portions are adhesively bonded to adjoining exposed surfaces of the silo around the joint to provide continuous air-tight seals, a separating medium being located between the joint and the bulging portion of the diaphragm.

2. A silo as claimed in claim 1, in which the diaphragm is reinforced by having embedded in it a reinforcement providing stiffly resilient parallel strands extending through the diaphragm and terminating in the edge-portions thereof.

3. A silo as claimed in claim 2, in which the strands comprise parallel nylon monofilaments held in position by crossing soft fibrous polyester filaments.

4. A silo as claimed in claim 3, in which the separating medium comprises an adhesive strip stuck to the joint beneath the bulging portion of the diaphragm.

5. A silo as claimed in claim 4, in which the joint extends between the lower end-portion of its side-wall and a plinth supporting the weight of the silo.

6. A silo as claimed in claim 5, in which the diagram extends around the outside of the silo.

7. A method of sealing an expansion joint of a grain silo, comprising the steps of placing a separation medium over one side of the joint, applying over the medium and adjacent portions of the silo a continuous thick layer of a viscous compound which cures to form a flexible diaphragm covering the joint and bonded tightly to the silo surfaces surrounding the joint but only weakly to the separating medium whereby subsequent working of the joint causes the intermediate portion of the diagram to separate from the medium and form a bulge spaced from the two spaces of the joint which move with respect to one another during working of the joint.

8. A method as claimed in claim 7, in which the viscous compound is applied in two superimposed layers, and between their applications reinforcement having stiffly resilient strands extending in the direction of working of the joint is placed on the layer first applied, and the second layer is applied so that it bonds with the first layer through interstices in the reinforcement.

9. A method as claimed in claim 8, in which the separating medium is an adhesively-backed paper strip stuck to the joint before the first layer is applied.

10. A grain silo comprising a plinth having a substantially horizontal upper surfrace, a wall structure seated on the plinth and movable relative thereto to accommodate expansion and contraction of the wall structure relative to the plinth, the wall structure having inner and outer surfaces, and sealing means for establishing a seal between the plinth and the wall structure, said sealing means comprising a flexible diaphragm which has two marginal edge-portions adhesively bonded to said upper surface of the plinth and one of said surfaces of the wall structure respectively and also has an intermediate region, between said marginal edge-portions which bulges away from the plinth and the wall structure and is movable relative thereto.

11. A silo as claimed in claim 10, wherein the wall structure is generally cylindrical and the diaphragm is substantially annular, the two marginal edge-portions of the diaphragm being an inner edge-portion and an outer edge portion respectively, and wherein the inner edge-portion of the diaphragm is bonded to the outer surface of the wall structure and the outer edge portion is bonded to the upper surface of the plinth outside the wall structure.

* * * * *